US006722589B1

(12) United States Patent
Ohno et al.

(10) Patent No.: US 6,722,589 B1
(45) Date of Patent: Apr. 20, 2004

(54) SLIP PREVENTION PARTICLE INJECTION DEVICE

(75) Inventors: Kaoru Ohno, Kokubunji (JP); Kosuke Matsuoka, Taito-ku (JP); Kouzou Watanabe, Taito-ku (JP)

(73) Assignees: Railway Technical Research Institute, Tokyo (JP); Nicchu Co., Ltd., Tokyo (JP)

( * ) Notice: Subject to any disclaimer, the term of this patent is extended or adjusted under 35 U.S.C. 154(b) by 227 days.

(21) Appl. No.: 09/959,567

(22) PCT Filed: Mar. 14, 2001

(86) PCT No.: PCT/JP01/01996

§ 371 (c)(1),
(2), (4) Date: Oct. 30, 2001

(87) PCT Pub. No.: WO01/68432

PCT Pub. Date: Sep. 20, 2001

(30) Foreign Application Priority Data

Mar. 17, 2000 (JP) ..... 2000/75747

(51) Int. Cl.[7] ..... A01C 15/04
(52) U.S. Cl. ..... 239/654; 291/3
(58) Field of Search ..... 239/650, 654, 239/655, 669, 683, 689; 291/3, 38

(56) References Cited

U.S. PATENT DOCUMENTS

| | | | | | |
|---|---|---|---|---|---|
| 847,270 | A | * | 3/1907 | Wise | 451/87 |
| 896,968 | A | * | 8/1908 | Barnett | 291/24 |
| 1,795,105 | A | | 3/1931 | Buyck | |
| 2,256,290 | A | | 9/1941 | McCune | |
| 2,352,252 | A | * | 6/1944 | Canetta | 291/11.1 |
| 2,515,341 | A | * | 7/1950 | Giguere | 126/271.1 |
| 2,606,780 | A | * | 8/1952 | Loftus | 291/3 |
| 2,999,711 | A | * | 9/1961 | Stormer | 291/3 |
| 3,345,097 | A | * | 10/1967 | Smith | 291/3 |
| 3,363,923 | A | * | 1/1968 | Parrish et al. | 291/3 |
| 3,888,524 | A | * | 6/1975 | Lee | 291/15 |
| 4,486,039 | A | * | 12/1984 | Jayne | 291/3 |
| 4,968,069 | A | * | 11/1990 | Jensen | 291/3 |
| 5,277,707 | A | | 1/1994 | Munk et al. | 95/8 |
| 5,580,106 | A | * | 12/1996 | Dulberg et al. | 291/3 |
| 5,811,164 | A | | 9/1998 | Mitchell | 428/36.5 |
| 6,270,118 | B1 | | 8/2001 | Ichikawa | 280/757 |
| 6,371,532 | B1 | * | 4/2002 | Skarie et al. | 291/38 |

FOREIGN PATENT DOCUMENTS

| | | |
|---|---|---|
| DE | 75525 | 6/1894 |
| EP | 0016471 | 10/1980 |
| GB | 1380872 | 1/1975 |
| GB | 2202506 | 9/1988 |
| JP | 58-202103 | 11/1983 |
| JP | 4-310464 | 11/1992 |

* cited by examiner

*Primary Examiner*—Gene Mancene
*Assistant Examiner*—Thach H Bui
(74) *Attorney, Agent, or Firm*—Sherman & Shalloway

(57) ABSTRACT

Problems are posed by slip prevention particle injection devices by wheels of railway rolling stock. Namely, if the injected quantity of slippage-preventing particles is adjusted so as not to be excessive and to be a suitable quantity, it is not possible to obtain a predetermined injection pressure and it is not possible to inject the particles at the target location.

The injector device of the present invention is constituted by providing an air through-flow duct 5 inside a particle retainer tank 1, and connecting an air supply duct 17 to this air through-flow duct 5. In the above mentioned tank 1, in addition to an air inflow duct 6 being provided in the vicinity of the inlet side of the air through-flow duct 5, an air discharge duct 18 is provided in the vicinity of the outlet side of the air through-flow duct 5. This air inflow duct 6 and air discharge duct 18 are connected to the air through-flow duct 5 and one end of these ducts 6 and 18 is open into the tank 1. Further, in addition to a mixing chamber 15 and a smaller-diameter air passage section 9 being provided in the air through-flow duct 5, a particle introduction hole 16 is provided in the mixing chamber 15, and an injector duct 21 that injects a fluid mixture of slippage-preventing particles and compressed air is provided at the outlet side of the air through-flow duct 5.

5 Claims, 4 Drawing Sheets

SLIP PREVENTION PARTICLE INJECTION DEVICE

TECHNICAL FIELD

The present invention relates to slip prevention particle injection devices which are installed in the vicinity of wheels of railway rolling stock and spread particles for preventing slippage of the wheels.

BACKGROUND ART

Rain or snow may cause slippage of wheels of railway rolling stock traveling at a high speed on rails. Indeed, wetting of the rails with rain or accumulation of snow thereon causes such effects as the decrease in tacking coefficient between the wheels and the rails, idle rotation of the wheels, decrease in traveling speed, and inability to reach the preset traveling speed. Furthermore, when brakes are applied to stop the railway rolling stock, it cannot be stopped in a predetermined stoppage position due to slippage of wheels and the stoppage time required to stop the railway rolling stock after the application of brakes is extended.

In order to resolve those problems, sand has been sprinkled between the wheels and the rails to prevent the slippage of the wheels. The conventional sand sprinkling devices had a simple structure composed of a tank for retaining the sand and a guiding duct for dropping the sand. Since the sand sprinkling mechanism was based on the sand falling under gravity, the sand was scattered by the wind pressure created by the traveling railway rolling stock and the sand was difficult to sprinkle accurately at the appropriate location between the wheels and rails.

Recently, the conventional sand sprinkling devices have been improved and a device spraying the sand by a jet has been developed.

Japanese Utility Model Application Laid-open No. S56-18203 disclosed a sand sprinkling device for railway rolling stock comprising a sand box retaining the sand, a sand sprinkling duct connected to the sand box, an air duct for feeding the air to the sand sprinkling duct, and an air duct for feeding the air to the sand box. In such a device, the sand retained in the sand box is introduced into the sand sprinkling duct by a suction force created by the compressed air fed into the sand sprinkling duct, and the sand is injected between the wheels and the rails by the compressed air.

Japanese Patent Application Laid-open No. S62-77204 disclosed a particle injector device for railway rolling stocks, comprising a particle supply duct for supplying particles such as sand and the like, a compressed air supply duct for supplying the compressed air, a mixing chamber connected to the particle supply duct and compressed air supply duct, and an injector duct connected to the mixing chamber and having an injection opening. In such a device, the compressed air supplied from the compressed air supply duct is mixed in the mixing chamber with the particles supplied from the particle supply duct and the particles together with compressed air are injected between the wheels and rails from the injection opening of the injector duct.

Japanese Examined Patent Application No. H5-14673 disclosed a particle injector device for railway rolling stock comprising a retainer tank for retaining particles such as sand and the like, a retainer chamber connected to the retainer tank via a transportation pipe, a particle supply duct connected to the retainer chamber, and a compressed air supply duct connected to an air supply duct. In this device, the compressed air is fed to the compressed air supply duct via the air supply duct, a suction force is generated in the vicinity of the outlet of the particle supply duct by the flow of compressed air, thereby introducing the particles present in the retainer chamber into the particle supply duct and injecting the particles together with the compressed air between the wheels and rails from the particle supply duct.

All of the devices described in the Japanese Utility Model Application Laid-open No. S56-18203, Japanese Patent Application Laid-open No. S62-77204, and Japanese Examined Patent Application No. H5-14673 comprise an injector duct for injecting the particles and have a structure in which compressed air is fed into the injector duct, the particles are mixed with the compressed air, and the particles are injected together with the compressed air between the wheels and rails. The drawback of all of the devices is in that the injected quantity of the particles is difficult to adjust.

Thus, the injection pressure has to be increased when the particles do not get in the appropriate location between the wheels and rails because of the wind or turbulent air flow generated in the vicinity of wheels of traveling railway rolling stock. However, the drawback of the conventional device is that the injected quantity is increased if the injection pressure is raised and the flow rate of compressed air is increased. The excessive injection of particles causes unnecessary consumption of particles and the cost of slippage prevention rises. Moreover, when the excessively sprinkled particles penetrate into a point gap, they make it impossible to operate the point or produce a negative effect on a signal circuit. Another drawback of the conventional devices is that if the compressed air quantity is adjusted so that the injected quantity does not become too high, the prescribed injection pressure cannot be obtained and the particles cannot be accurately injected at the target location between the wheels and rails.

Thus, when an attempt was made to inject the particles accurately at the target location under the prescribed injection pressure, the injected quantity became too high. On the other hand, when the compressed air quantity was adjusted so as to control the injected quantity to the appropriate level, the injection pressure was insufficient, the particles were not injected at the target location, and the adjustment of the injected quantity of particles was difficult.

Japanese Unexamined Patent Application No. H4-310464 disclosed a particle injector device for railway rolling stock comprising a tank retaining the particles, a mixing apparatus connected to the particle retainer tank, an air duct for feeding compressed air to the particle retainer tank, an air duct which is a branch of the aforesaid air duct and serves to feed compressed air into the mixing apparatus, a control apparatus for controlling the quantity of particles introduced from the particle retainer tank into the mixing apparatus, an injector duct connected to the mixing apparatus, and a pinch valve for adjusting the injected quantity. In such apparatus, particles are introduced into the mixing apparatus from the tank in which the pressure is increased by the compressed air, the particles are mixed with the compressed air inside the mixing apparatus, and the particles are injected together with compressed air between the wheels and rails from the injection opening of the injector duct. In this case, the quantity of particles introduced into the mixing chamber from the tank is adjusted to the prescribed quantity by the control apparatus. Furthermore, the injected quantity from the injector duct is adjusted by the pinch valve.

The device disclosed in Japanese Unexamined Patent Application No. H4-310464 adjusts the injected quantity of particles, but the device requires a plurality of control apparatuses and an accordingly large number of electric wirings and has a complex structure. The slip prevention particle injection devices of this type are typically installed in the vicinity of wheels, in other words, so that they are exposed to the outside. Therefore, the materials thereof are subjected to corrosion or degradation. As a result, the control apparatus can malfunction or the electric wiring system can be damaged. For those reasons, there is a need for slip prevention particle injection devices which have a simple structure.

Accordingly, the inventors have conducted an intensive study aimed at the development of an injector device in which compressed air is fed into a particle retainer tank and a mixing chamber, pressure inside the tank is increased by the compressed air, particles are fed out into the mixing chamber by the respective pushing force, the particles are mixed with the compressed air in the mixing chamber, and the prescribed quantity of particles are injected from an injector duct together with the compressed air, without providing a mechanism for electric control of the injected quantity. In the course of the study, the inventors have set the following tasks.

The first task is associated with the difficulty of adjusting the injected quantity of particles. The structure in which a pressure is applied inside the tank by compressed air and the particles present in the tank are fed out into the mixing chamber by the respective pushing force essentially cannot resolve the above-described problem of injected quantity adjustment. Thus, the following problems were involved: if the particles are injected by the prescribed injection pressure, the injected quantity becomes too large, and, conversely, if the injected quantity is adjusted to an appropriate level, the injection pressure necessary for spraying the particles cannot be obtained and the particles cannot be sprayed at the target location.

The second task is associated with the movement of particles under the effect of residual pressure inside the tank when the particle spraying operation is terminated.

In a structure comprising no mechanism for controlling the injected quantity, no on-off valve is installed in the passage connecting the mixing chamber and the injector duct and the passage remains open. However, when the particle spraying operation is terminated, the air flow passage through which compressed air is supplied is closed and the supply of compressed air into the particle retainer tank and mixing chamber is terminated. In this case, because of the residual pressure inside the tank, the particles located inside the tank are pushed by this residual pressure and, as a result, the particles are fed out into the mixing chamber. The particles that were fed out into the mixing chamber flow into the injector duct and stay inside the injector duct and in the vicinity of the nozzle. The residual pressure is not sufficient to inject the particles from the injector duct to the outside.

If the particle spraying operation is resumed, the air passage is opened and compressed air is fed to the tank and mixing chamber. However, in this case, the initial air pressure does not provide a force necessary to inject the particles that stayed inside the injector duct at the target location between the wheels and rails. As a result, a situation is created in which rather large particle aggregates fall onto the rails from the nozzle under gravity. It means that the spraying of particles cannot be conducted in a stationary state immediately after the particle spraying operation has been restarted. Thus, in this case, the particles flowing out of the injector duct immediately after the particle spraying operation has been restarted are not injected at the target location between the wheels and rails and therefore make no contribution to slippage prevention and are consumed uselessly.

Furthermore, on the rainy or snowy days, water penetrates into the nozzle of the injector duct, particles that stayed in the vicinity of the nozzle of the injector duct are wetted with water, forming a solid mass and filling and clogging the nozzle.

With the foregoing in view, it is an object of the present invention to provide a slip prevention particle injection device in which the injected quantity of particles can be adjusted to an appropriate level with a simple structure.

Another object of the present invention is to provide a slip prevention particle injection device in which particles present in the tank are prevented from being fed into the injector duct and from staying therein when the particle spraying operation is terminated.

Still another object of the present invention is to provide a slip prevention particle injection device which has a low production cost, decreased particle consumption, and very good cost efficiency.

DISCLOSURE OF THE INVENTION

The particle retainer tank retains a preset quantity of particles for preventing slippage, and an air through-flow duct is provided inside the tank. An air supply duct for supplying compressed air is connected to the air through-flow duct. An air inflow duct is provided so as to be connected to the air through-flow duct in a state in which one end thereof is opened in the tank. The compressed air supplied from the air supply duct flows through the air through-flow duct and into the air inflow duct which is a branch of the air through-flow duct. The air inflow duct is preferably provided inside the tank. Air flow rate adjustment means for adjusting the flow rate of compressed air can be provided in the air inflow duct.

A smaller-diameter air passage section formed by narrowing the air passage is provided in the air through-flow duct. The position where the smaller-diameter air passage section is provided is preferably in the vicinity of the connection section connecting the air through-flow duct and air inflow duct. Further, a mixing chamber where the particles are mixed with compressed air is provided in the air through-flow duct. The particle introduction hole for introducing particles into the mixing chamber is also provided; this particle introduction hole is preferably provided directly in the mixing chamber.

One end of the air discharge duct is provided so as to be connected to the air through-flow duct in a state in which it is open inside the tank. The air through-flow duct is preferably provided inside the tank. When the air through-flow duct is provided inside the tank, the connection section of the air through-flow duct and air discharge duct is provided in a location at the outlet side of the air through-flow duct beyond the mixing chamber. An injector duct is connected to the outlet side of the air through-flow duct, and a nozzle is provided at the tip of the injector duct.

It is preferred that an observation window be provided in the tank to check visually the quantity of particles retained in the tank.

The configuration of the device in accordance with the present invention is such that the air through-flow duct and air inflow duct are provided and the supply of compressed air is branched into the air through-flow duct and air inflow duct. Moreover, a smaller-diameter air passage section is provided in the air through-flow duct. Therefore, the quantity of compressed air flowing into the mixing chamber can be made less than the quantity of compressed air flowing into the air inflow duct. As a result, the quantity of particles introduced into the mixing chamber from the particle introduction hole by the negative pressure generated in the mixing chamber is also adjusted to an appropriate quantity and excessive quantity of particles is not introduced therein.

On the other hand, compressed air branched out of the air through-flow duct and flowing in the air inflow duct is supplied into the tank and increases pressure therein. However, a portion of the compressed air that has flown into the tank flows out into the air through-flow duct via the air discharge duct. As a result, a high internal pressure corresponding to the quantity of compressed air supplied into the tank is not formed. Therefore, the pressure inside the tank does not create a pushing force sufficient to introduce the excessive quantity of particles from the particle introduction hole into the mixing chamber. Therefore, the appropriate quantity of particles is introduced into the mixing chamber. Since the entire quantity of compressed air flowing in the air through-flow duct, air inflow duct, and air discharge duct is used for particle injection, the particles can be injected under the preset injection pressure.

Thus, in accordance with the present invention, the injected quantity of particles can be adjusted to an appropriate quantity, without becoming excessive during particle spraying, and the unnecessary consumption of particles can be prevented. Preventing the excessive injected quantity makes it possible to resolve the conventional problems such as the introduction of excessively sprinkled particles into a point gap, which disables the point, and a negative effect produced on a signal circuit.

Furthermore, providing means for adjusting the air flow rate in an air inflow duct makes it possible to adjust the flow rate of compressed air supplied into the tank and therefore to change, as necessary, the injected quantity of particles.

In accordance with the present invention, when the particle spraying operation is terminated, the air present inside the tank flows via the air discharge duct into the air through-flow duct and then from the air through-flow duct into the injector duct from which it is released into the atmosphere. Therefore, the residual pressure inside the tank is rapidly decreased and the occurrence of situation in which the residual pressure inside the tank introduces the particles into the mixing chamber, moves them into the injector duct, and causes them to stay inside the injector duct and in the vicinity of the nozzle can be prevented. As a result, in accordance with the present invention, when the particle spraying operation is restarted, particle injection in a stationary state can be conducted immediately after the operation has been restarted, so that a large quantity of staying particles are not pushed out from the injector duct and nozzle and do not fall on the rails.

Furthermore, as described above, since the particles do not stay in the vicinity of the nozzle when the particle spraying operation is terminated, there is no danger that water will permeate from the nozzle and harden the particles into a mass, thereby clogging the nozzle.

The injector device in accordance with the present invention has a simple structure. Therefore, the production cost is low. Moreover, since the consumption of particles is decreased, the cost of preventing slippage is reduced and the device has a very high cost efficiency.

BEST MODE FOR CARRYING OUT THE INVENTION

Figure 1:
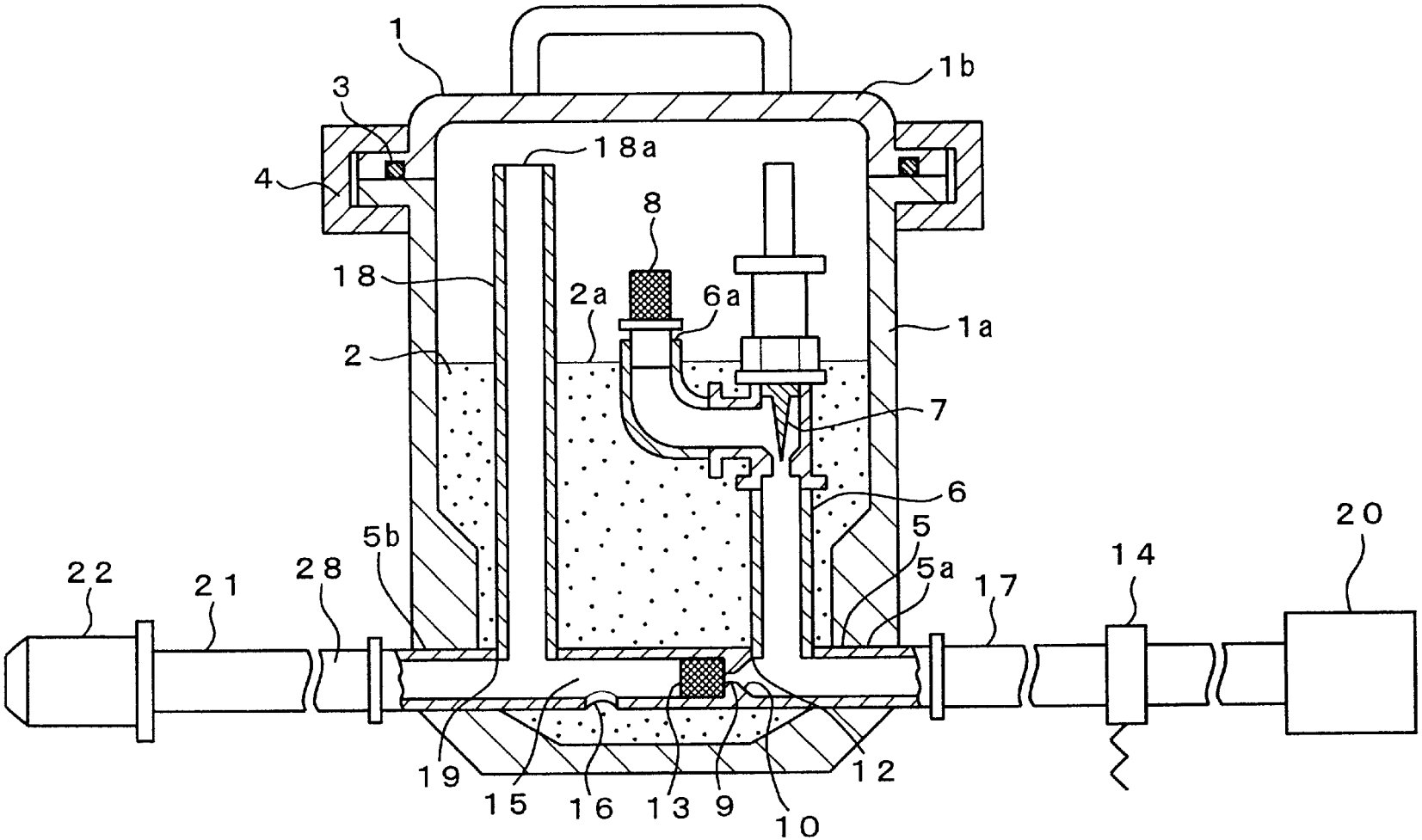
FIG. 1 is a longitudinal sectional view of the injector device in accordance with the present invention.

FIG. 1 illustrates an embodiment of the injector device in accordance with the present invention. In the figure, the reference numeral 1 stands for a particle retainer tank retaining slippage-preventing particles 2. The tank 1 comprises a tank body 1*a* and a cover 1*b* and is constructed as a pressure-resistant sealed container. The pressure resistance ability of tank 1 is preferably no less than 10 kgf/cm$^2$. The tank 1 is opened via the cover 1*b* and the inside of the tank body 1*a* is filled with the prescribed quantity of slippage-preventing particles 2. In a closed state, air-tight contact between the tank body 1*a* and cover 1*b* is maintained by an O ring 3. Moreover, the cover 1*b* is tightly secured to the tank body 1*a* with a locking part 4.

Any particles increasing tacking coefficient between the wheels and rails may be used as the slippage-preventing particles 2. Examples of suitable particles include natural sand, silica sand, alumina particles, metal particles, or ceramic particles such as mullite and the like. The diameter of particles 2 is preferably 10–500 $\mu$m.

An air through-flow duct 5 is provided horizontally in a lower location inside the tank 1. Both ends of the air through-flow duct 5 are open to the outside of tank 1. An air supply duct 17 for supplying compressed air is connected to one end of the air through-flow duct 5 and an injector duct 21 is connected to another end thereof via a connection part 28. Furthermore, an air inflow duct 6 is provided in the vicinity of the inlet of the air through-flow duct 5 inside the tank 1, an air discharge duct 18 is provided in the vicinity of the outlet of the air through-flow duct 5, and both the air inflow duct 6 and the air discharge duct 18 are connected to the air through-flow duct 5. One end of the air inflow duct 6 is open in the tank 1 and another end thereof is connected to the air through-flow duct 5. With such a structure, the flow of compressed air supplied from the air supply duct 17 is branched out into the air through-flow duct 5 and air inflow duct 6.

Air flow rate adjustment means for adjusting the flow rate of compressed air is provided in the air inflow duct 6. A needle valve 7 is preferably used as air flow rate adjustment means. The quantity of compressed air flowing from the opening 6*a* of air inflow duct 6 into the tank 1 can be adjusted by adjusting the position of needle valve 7 in the vertical direction.

A filter 8 is installed in the opening 6*a* of air inflow duct 6. The filter 8 prevents particles 2 located in the tank 1 from flowing into the air inflow duct 6 from the opening 6*a*. If the particles 2 flow from the opening 6*a* into the air inflow duct 6, the valve mechanism of the needle valve 7 can be damaged. Therefore, the filter 8 has to be installed to prevent such an event. However, when the opening 6*a* is located in a position sufficiently higher than the particle accumulation surface 2*a*, there is no danger that the particles 2 will flow from the opening 6*a* into the air inflow duct 6 and it is not necessary to install the filter 8 in the opening 6*a*. When the filter 8 is installed in the opening 6*a*, the particles 2 cannot flow into the air inflow duct 6. Therefore, the opening 6*a* and filter 8 may be provided so as to be positioned inside the particle accumulation layer.

Figure 3:
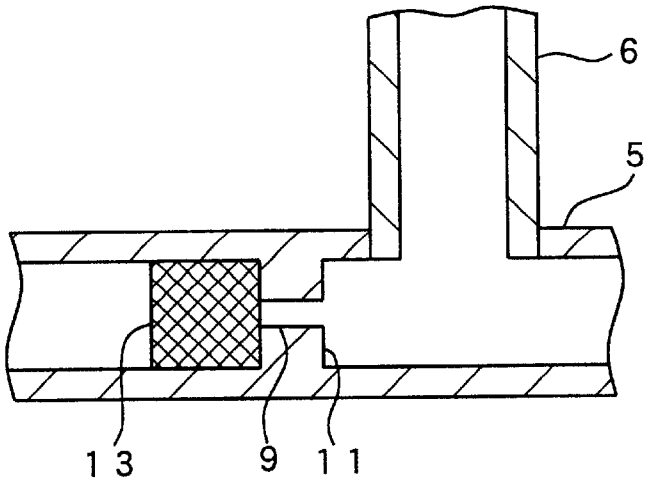
FIG. 3 is a longitudinal sectional view illustrating another example of configuration of the peripheral wall of the inlet of the smaller-diameter air passage section.

A smaller-diameter air passage section 9 is provided in the air through-flow duct 5. The smaller-diameter air passage section 9 is a section obtained by narrowing the air passage of air through-flow duct 5. The peripheral wall of the inlet of smaller-diameter air passage section 9 may be in the form of a tapered surface 10 such that the passage diameter is gradually getting smaller, as shown in FIG. 1, or it may be in the form of a vertical surface 11 producing steps perpendicular to the upper surface or lower surface in the cross section thereof, as shown in FIG. 3. The smaller-diameter air passage section 9 is preferably provided in the vicinity of the connection section 12 connecting the air through-flow duct 5 and air inflow duct 6.

A filter 13 and a mixing chamber 15 are provided sequentially at the outlet side of smaller-diameter air passage section 9, and the mixing chamber 15 is provided with a particle introduction hole 16 for introducing particles 2 located inside the tank 1. The particle introduction hole 16 can be provided in other positions outside of the mixing chamber 15, but it is preferably provided directly in the mixing chamber 15.

Suppose that the flow of particles 2 in the air through-flow duct 5 is reversed and the particles 2 flow toward the inlet opening 5*a* (such event is, however, quite unusual). In this case, the valve mechanism of the below-described electromagnetic valve 14 can be damaged. The filter 13 impedes such a flow of particles and prevents the particles from entering the inlet opening 5*a* of air through-flow duct 5. Furthermore, filter 13 changes the flow of compressed air entering the mixing chamber 15 from the smaller-diameter air passage section 9 from a laminar flow to a turbulent flow and reduces the negative pressure generated in the mixing chamber 15. For example, a sintered filter can be used as the filter 13 and the above-described filter 8.

The mixing chamber 15 provided in the air through-flow duct 5 at the outlet 5*b* side beyond the filter 13 is integrated with the air through-flow duct 5. Thus, a mixing area in which the particles are mixed with compressed air is formed inside the air through-flow duct 5, and this mixing area constitutes the mixing chamber 15. The present invention is not limited to integrating the mixing chamber with the air through-flow duct 5, and the mixing chamber can be provided separately from the air through-flow duct 5 so as to be connected thereto.

One end of the air discharge duct 18 is open inside the tank 1 and the other end thereof is connected to the air through-flow duct 5. The position in which the air discharge duct 18 is connected to the air through-flow duct 5, that is, the position of connection section 19 of the air through-flow duct 5 and air discharge duct 18 is preferably at the outlet 5*b* side of air through-flow duct 5 beyond the mixing chamber 15.

The opening 18*a* of the air discharge duct 18 is positioned so as to protrude upward beyond the particle accumulation surface 2*a*, and there is no danger that the particles will enter the air discharge duct 18 through the opening 18*a*. However, even if the particles entered the air discharge duct 18, because no valve mechanism that can be in direct contact with the particles which entered the air discharge duct 18 is present in the air passage connected to the air discharge duct 18, no particular hindrance is created.

The air through-flow duct 5, air inflow duct 6, air discharge duct 18, and smaller-diameter air passage section 9 preferably have structures with air passages having a round cross section, but this condition is obviously not limiting and they may have a structure with air passages having a quadrangle cross section. When the air through-flow duct 5 and smaller-diameter air passage section 9 have a structure with air passages having a round cross section, if the inner diameter of air through-flow duct 5 is, for example, 10–15 mm, the passage diameter of smaller-diameter air passage section 9 is preferably 0.5–2.5 mm, even more preferably, 1–2 mm. Moreover, in this case, the diameter of particle introduction hole 16 is preferably 1.5–3.5 mm, even more preferably, 2–3 mm.

Since the smaller-diameter air passage section 9 is provided in the air through-flow duct 5, the quantity of compressed air flowing into the air inflow duct 6 is larger than the quantity of compressed air flowing through the smaller-diameter air passage section and into the mixing chamber 15, and most of the compressed air is supplied into the tank 1 through the air inflow duct 6. The compressed air supplied into the tank 1 raises pressure inside the tank 1 and acts so as to introduce the particles into the mixing chamber 15. Furthermore, since it flows into the air through-flow duct 5 via the air discharge duct 18, the compressed air is supplied into the mixed fluid of particles and compressed air, which flows through the air through-flow duct 5, thereby increasing the quantity of compressed air in the mixed fluid and producing a mixed fluid with a high mixing ratio of air. Therefore, the smaller-diameter air passage section can be defined as a section formed by narrowing the air passage section so as to introduce into the tank 1 the quantity of compressed air which is required to obtain a mixing fluid of particles and compressed air having a high mixing ratio of air. The diameter of this passage is set according to the inner diameter of the air through-flow duct 5.

An air supply system usually installed on railway rolling stocks can be used in accordance with the present invention as the system for supplying the compressed air. A base air collector 20 feeding compressed air to a brake circuit is installed in the air supply system, and the device in accordance with the present invention can use this base air collector 20 as a source for supplying the compressed air. Thus, an air supply duct 17 is connected to the base air collector 20 and compressed air is supplied into the air supply duct 17 from the base air collector 20. An electromagnetic valve 14 operates by opening and closing the passage of the air supply duct 17, thereby supplying the compressed air to the air through-flow duct 5 or terminating the supply.

A nozzle 22 is provided at the tip of the injector duct 21 connected to the outlet side of air through-flow duct 5.

Figure 2:
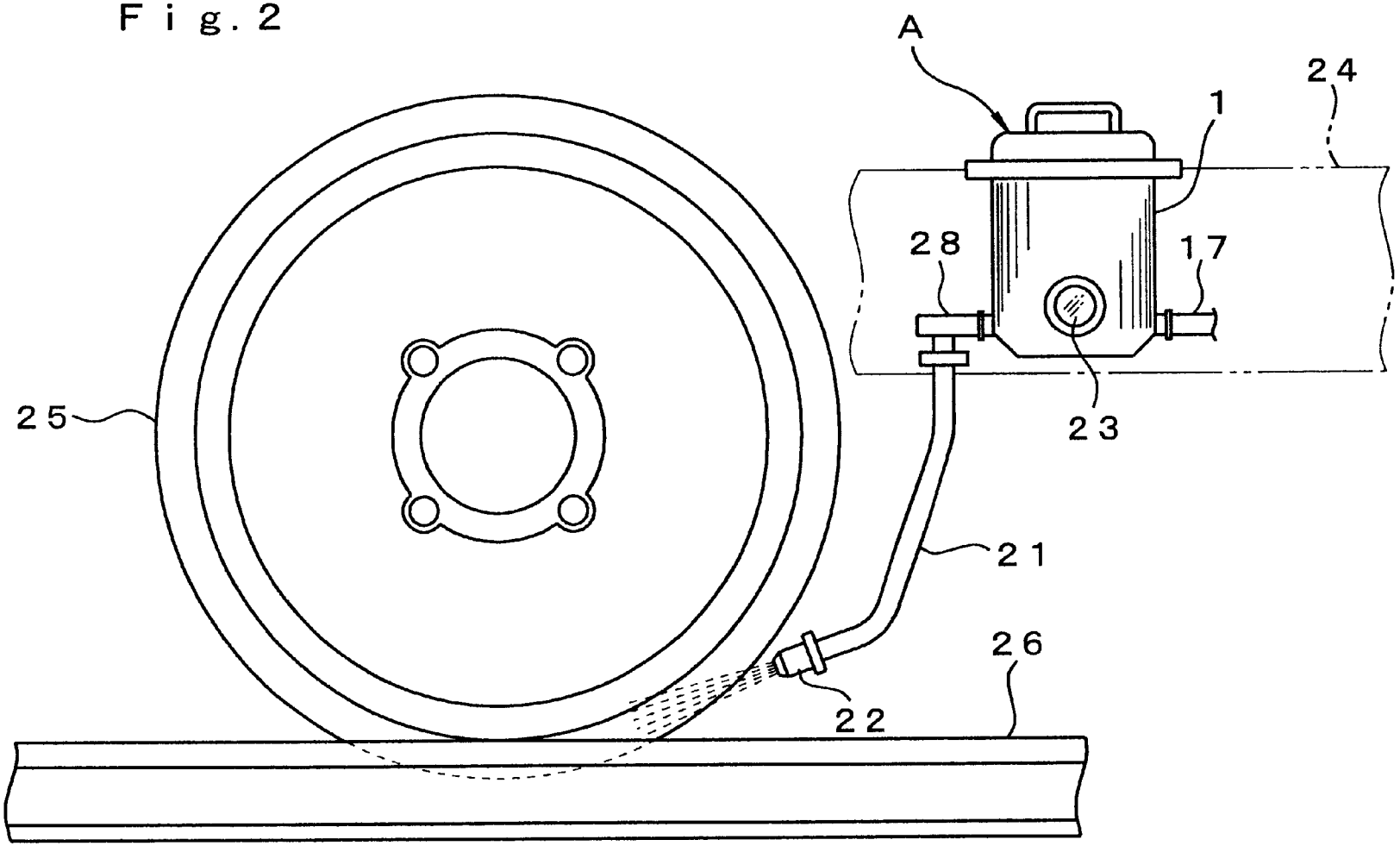
FIG. 2 illustrates a state in which the injector device in accordance with the present invention is attached to a railway rolling stock and particle spraying is conducted.

An observation window 23 is provided in the side wall surface of tank 1, as shown in FIG. 2. The observation window 23 is constituted by fitting a transparent sheet such as glass sheet, acrylic sheet, or the like, into the window opening. The quantity of particles retained in the tank 1 can be checked by looking into the tank 1 through the observation window 23. The position in which the observation window 23 is provided is located in the vicinity of the air through-flow duct 5 inside the tank 1, preferably, so as to allow for viewing the particle accumulation surface 2*a* that has lowered to the vicinity of the air through-flow duct 5. When the particle accumulation surface 2*a* has lowered to the vicinity of the air through-flow duct 5, it is necessary to open the cover 1*b* and fill the tank body 1*a* with particles.

The injector device in accordance with the present invention, which has the above-described configuration, is installed at the railway rolling stock frame 24, as shown in FIG. 2. In this figure, A stands for the injector device in accordance with the present invention. With the tank 1 secured to the frame 24, the injector duct 21 is disposed so as to be extended in the direction of wheel 25, and the nozzle 22 provided at the tip of the injector duct 21 is directed so that particles can be injected between the wheel 25 and rail 26.

The operation of the device in accordance with the present invention will be described below. The electromagnetic valve 14 is opened and compressed air is supplied from the base air collector 20 to the air supply duct 17. The compressed air flows into the air through-flow duct 5 inside the tank via the air supply duct 17, flows inside the air through-flow duct 5 toward the mixing chamber 15, and upon branching also flows into the air inflow duct 6. Because the compressed air that flows inside the air through-flow duct 5 toward the mixing chamber 15 passes through the smaller-diameter air passage section 9, the narrow section of this passage determines the rate of the flow, and the quantity of compressed air flowing into the air inflow duct 6 becomes larger than the quantity of compressed air flowing into the mixing chamber 15. The compressed air flowing through the air inflow duct 6 is supplied into the tank 1, thereby increasing the pressure inside the tank 1.

When the compressed air flows from the air through-flow duct 5 toward the mixing chamber 15, it is compressed while passing through the smaller-diameter air passage section 9. Since the compression state is released when the air enters the mixing chamber 15, a negative pressure is produced in the mixing chamber 15. Therefore, a suction force acts and the particles 2 present inside the tank 1 enter the mixing chamber 15 via the particle introduction duct 16. Since, as described above, the quantity of compressed air flowing into the mixing chamber 15 is less than the quantity of compressed air flowing into the air inflow duct 6, a large negative pressure is not generated in the mixing chamber 15 and a comparatively low pressure remains as it is. Furthermore, since the filter 13 acts so as to change the flow of compressed air entering the mixing chamber 15 from the smaller-diameter air passage section 9 from a laminar flow into a turbulent flow, this action also suppresses the generation of a large negative pressure in the mixing chamber 15. Thus, the generation of a large negative pressure in the mixing chamber 15 can be suppressed by the combined action of the smaller-diameter air passage section 9 and filter 13. As a result, the quantity of particles that are sucked in and flow into the mixing chamber 15 remains constant and the excess quantity of particles does not flow into the mixing chamber 15. Thus, the suction force generated in the mixing chamber 15 is appropriately controlled by the action of smaller-diameter air passage section 9 and filter 13.

The particles are introduced into the mixing chamber 15 not only under the effect of the aforesaid suction force, but also by the pushing force created by the internal pressure in the tank. Thus, as described above, the, pressure inside the tank 1 is increased by the compressed air supplied into the tank 1 from the air inflow duct 6, and the particles enter the mixing chamber 15 via the particle introduction hole 16 under the effect of a pushing force crated by this pressure. Since a portion of the compressed air supplied into the tank 1 flows into the air discharge duct 18 and flows out into the air through-flow duct 5 via the air discharge duct 18, a high pressure sufficient to feed the excess quantity of particles into the mixing chamber 15 is not generated inside the tank 1. Thus, the pushing force generated inside the tank 1 is appropriately controlled by the action of the air discharge duct 18.

Forces introducing the particles into the mixing chamber 15 are a suction force in the mixing chamber 15 and a pushing force inside the tank 1. However, since the suction force and pushing force are appropriately controlled in the above-described manner, the excess quantity of particles do not flow into the mixing chamber 15.

Thus, the compressed air supplied from the air supply duct 17 produces three channels of flow: (1) a flow directed from the air through-flow duct 5 to the mixing chamber 15, (2) a flow entering the tank 1 from the air inflow duct 6 and directed to the mixing chamber 15 via the particle introduction hole 16, (3) a flow directed from inside the tank 1 to the air through-flow duct 5 via the air discharge duct 18. The flow of compressed air is thus divided into three channels of flow, but since the flows of compressed air in these channels merge in the outlet 5*b* of air through-flow duct 5, a preset injection pressure necessary to inject the particles at a high speed is obtained. Therefore, since the particles can be injected from the nozzle 22 under a preset injection pressure, they can be accurately sprayed in the target position between the wheel 25 and rail 26. Such spraying of the particles increases tacking coefficient between the wheel 25 and rail 26, prevents slippage of the wheel and makes it possible to maintain a preset traveling speed in a rainy or showy days or reliably stop a railway rolling stock by applying the brakes.

Among the above-described flows of compressed air in three channels, the flow from the tank 1 and into the air through-flow duct 5 via the air discharge duct 18 makes no contribution to feeding the particles into the mixing chamber 15 and the entire compressed air in this channels is supplied into the air through-flow duct 5. The compressed air supplied through the air discharge duct 18 is mixed with a mixed fluid of the particles and compressed air that flows through the air through-flow duct 5. As a result, the quantity of compressed air in the mixed fluid is increased, a mixed fluid with a high mixing ratio of air is obtained, and this mixed fluid with a high mixing ratio of air is injected from the nozzle 22. Thus, the particles can be reliably injected in the target position between the wheel 25 and rail 26 by injecting the mixed fluid with a high mixing ratio of air and the injection angle cannot be easily shifted even under the effect, for example, of side wind. Furthermore, by obtaining a mixed fluid with a high mixing ratio of air, it is possible to adjust the quantity of injected particles to an appropriate quantity and prevent the injection of an unnecessary large quantity of particles.

In accordance with the present invention, as described above, the quantity of injected particles can be adjusted to an appropriate quantity, but the injected quantity can be increased or decreased if necessary. The needle valve 7 may be operated to increase or decrease the injected quantity. The flow rate of compressed air fed from the air inflow duct 6 into the tank 1 can be adjusted by operating the needle valve 7. For example, if the flow rate of compressed air fed into the tank 1 is raised, the quantity of particles flowing into the mixing chamber 15 can be enlarged and the injected quantity of particles can be increased. Conversely, if the flow rate of compressed air fed into the tank 1 is reduced, the quantity of particles flowing into the mixing chamber 15 can be lowered and the injected quantity of particles can be decreased.

Thus, the injected quantity of particles can be increased or decreased, if necessary, by operating the needle valve 7.

When the particle spraying operation is terminated, the electromagnetic valve 14 is closed and the supply of compressed air from the air supply duct 17 is terminated. At this time the residual pressure inside the tank 1 rapidly drops under the effect of air discharge duct 18. Thus, since the pressure difference is produced between the inside and outside of the tank 1, the compressed air present inside the tank 1 passes through the air discharge duct 18, flows out into the air through-flow duct 5, and is released under the atmospheric pressure through the injector duct 21. As a result, the residual pressure inside the tank 1 drops rapidly. Because of such rapid drop in residual pressure in the tank 1, a pushing force sufficient to feed the particles into the mixing chamber 15 is not produced in the tank 1, and the particles do not flow into the mixing chamber 15.

Therefore, when the particle spraying operation is terminated, the particles do not stay inside the injector duct 21 or in the vicinity of the nozzle 22. As a result, when the particle spraying operation is restarted, particle injection in a stationary state can be conducted immediately after the operation has been restarted, without a large quantity of staying particles being pushed out from the injector duct 21 and nozzle 22 and dropped onto the rail. The fact that the particle injection in a stationary state can be conducted immediately after the operation has been restarted means that the particles can be accurately sprayed at the target location between the wheel 25 and rail 26 immediately after the operation has been restarted. Furthermore, since particles do not stay inside the injector duct 21 and in the vicinity of nozzle 22, the particles are not hardened into a mass and do not clog the nozzle even if water penetrates from the nozzle 22.

Suppose that particles are introduced into the mixing chamber 15 by the residual pressure inside the tank 1. Even in this case, as described above, since the pushing pressure is small, the quantity of the particles introduced into the mixing chamber 15 is insignificant, and even if such insignificant quantity of particles is fed into the injector duct 21, the stationary particle injection immediately after the particle spraying operation has been restarted is not hindered in any way and stationary particle injection can be conducted.

Figure 4:
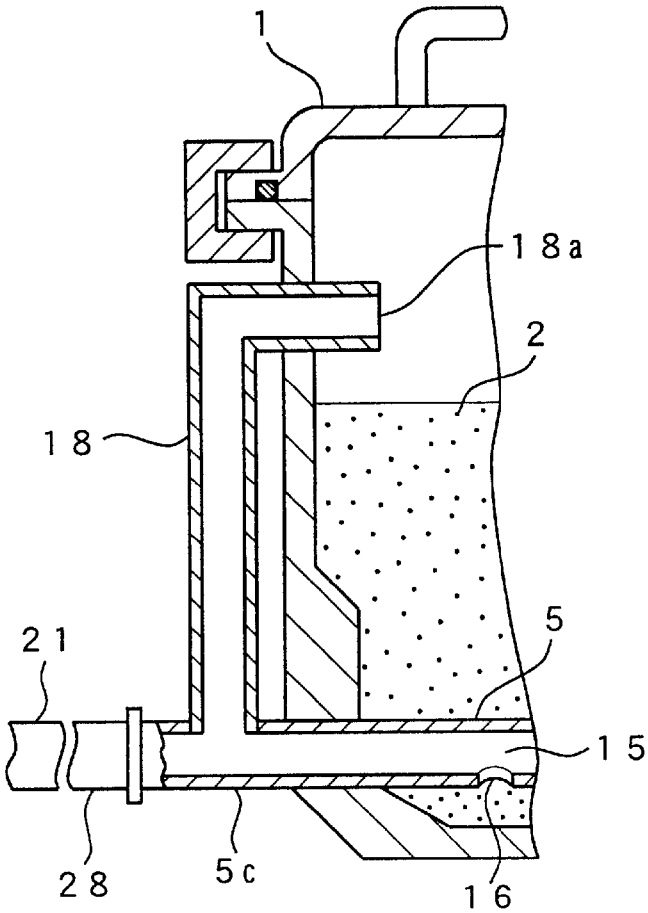
FIG. 4 is a longitudinal sectional view illustrating the main portion of another embodiment of the present invention.

The present invention is not limited to the above-described embodiment and various design modifications can be made without departing from the essence of the present invention. For example, the air discharge duct 18 may be provided outside the tank 1, as shown in FIG. 4. In this case, one end of air discharge duct 18 is open inside the tank 1 and another end thereof is connected to the outer extended portion 5*c* of air through-flow duct 5. Such configuration also provides for the effect identical to that of the embodiment illustrated by FIG. 1.

Figure 5:
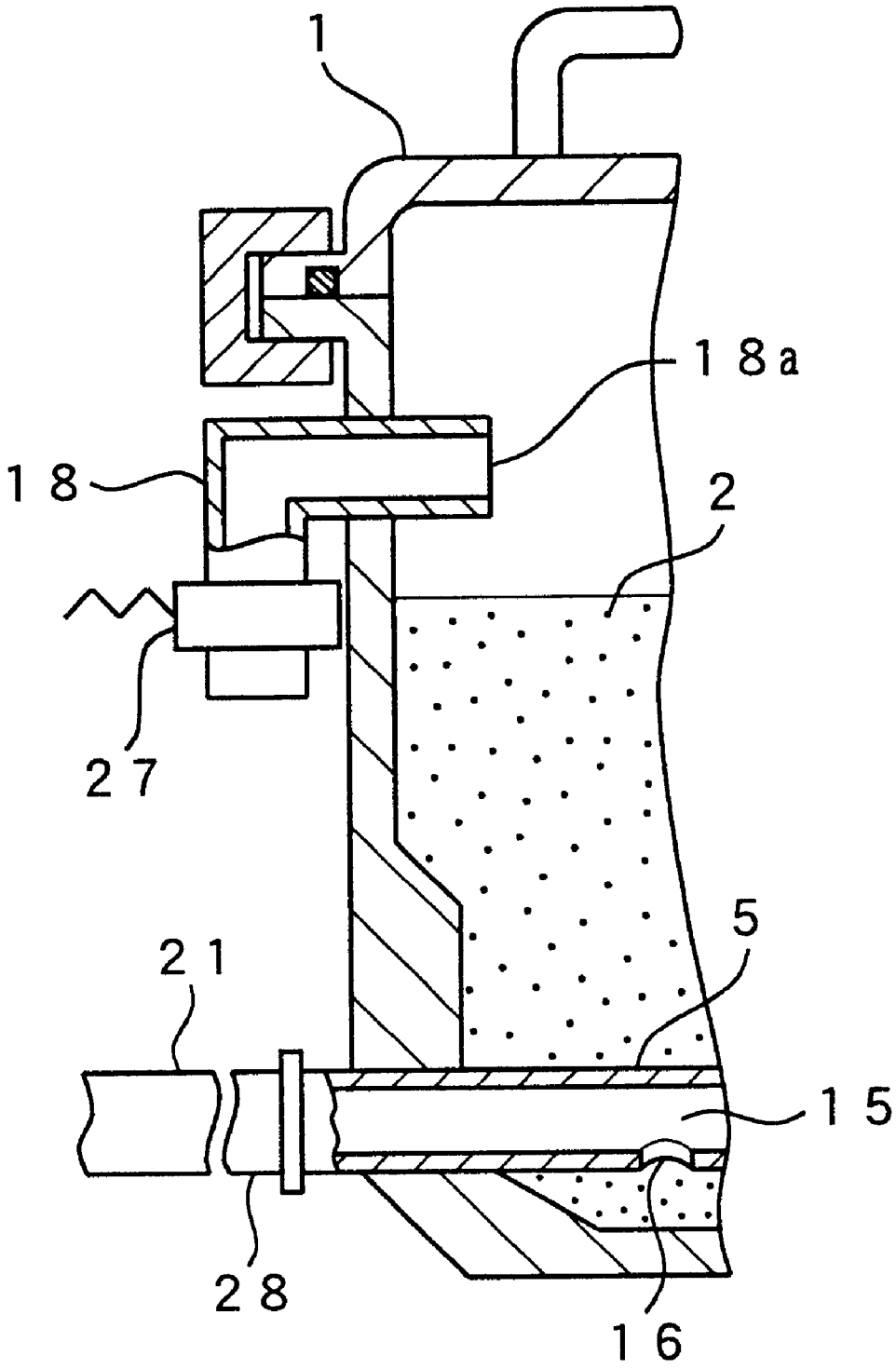
FIG. 5 is a longitudinal sectional view illustrating the main portion of still another embodiment of the present invention.

In accordance with the present invention, it is not necessary to connect the air discharge duct to the air through-flow duct when the only object is to prevent the particles from being moved by the residual pressure and from staying inside the injector duct and in the vicinity of nozzle when the particle spraying operation is terminated. Such an embodiment is illustrated by FIG. 5. As shown in the figure, the air discharge duct 18 is formed to have a smaller size, one end thereof is open inside the tank, and another end thereof protrudes to the outside beyond the tank 1, and an electromagnetic valve 27 is installed at the portion thereof position outside of the tank 1. When the particle spraying operation is conducted, the electromagnetic valve 27 is closed and the air passage of air discharge duct 18 is closed. When the particle spraying operation is terminated, the electromagnetic valve 27 is opened and the air passage of air discharge duct 18 is opened.

If the air passage of air discharge duct 18 is thus opened when the particle spraying operation is terminated, the compressed air present in the tank 1 is released to the outside of tank 1 through the air passage of air discharge duct 18 and the residual pressure in tank 1 rapidly drops. As a result, the particles are prevented from moving through the mixing chamber 15 into the injector duct 21 and staying therein.

INDUSTRIAL APPLICABILITY

The present invention provides a slip prevention particle injection device which prevents the slippage of wheels of railway rolling stock by spraying slippage-preventing particles between the wheels and rails. The industrial value of the present invention is in that the excessive injected quantity can be prevented and the unnecessary consumption of particles can be avoided by adjusting the injected quantity of particles to an appropriate quantity, which makes it possible to provide a cost-efficient injector device.

What is claimed is:

1. A slip prevention particle injection device, comprising:

a particle retainer tank (1) for retaining the preventing slippage particles, an air through-flow duct (5) provided inside said tank, an air flow duct (6) provided so as to be communicated with the air through-flow duct in a state in which one end thereof is open inside said tank, an air supply duct (17) for supplying compressed air to the air through-flow duct and the air inflow duct, a smaller-diameter air passage section (19) provided in the air through-flow duct (5), a mixing chamber (15) for mixing said particles with compressed air, a particle introduction hole (16) for introducing said particles into the mixing chamber, an air discharge duct (18) having one end thereof open inside said tank, and an injector duct (21) for injecting said particles together with compressed air, wherein an air flow rate adjusting means (7) for adjusting the flow rate of compressed air is provided in said airflow duct, said air supply duct (17) is connected to the air flow-through duct (5) in the vicinity of a tank inlet opening (5*a*), said smaller-diameter air passage section (9) is provided on the side of the mixing chamber (15) for said particles and compressed air in the vicinity of the connection portion of said air flow-through duct and said air inflow duct, said injector duct (21) is connected to the outlet side of the air flow-through duct (5), and an injector nozzle (22) is provided at the distal end of said injector duct, the compressed air supplied from the air supply duct is branched into the air flow-through duct (5) and the air inflow duct (6) connected to the air flow-through duct (5), the compressed air flowing in the air inflow duct is introduced into the particle retaining tank from an opening (6*a*) of the air inflow duct, the pressure inside the tank is increased, the particles are introduced from said particle introduction hole (16) into said mixing chamber (15) by applying the appropriate pushing force to the particles present in the tank, the particles and the compressed air introduced from the smaller-diameter air passage section (9) provided in said air inflow duct (5) are mixed together inside said mixing chamber, and the particles mixed with air are injected from the injector nozzle (22) via the injector duct (21) connected to the air through-flow duct (5).

2. The slip prevention particle injection device, according to claim 1, wherein one end of the air discharge duct (18) having an opening inside said tank is connected at a location at the outlet side (5*b*) of the air through-flow duct (5) with respect to said mixing chamber (15).

3. The slip prevention particle injection device, according to claim 2, wherein said air discharge duct (18) is connected at a location at the outlet side (5*b*) of the air through-flow duct with respect to said mixing chamber (15) inside the particle retaining tank.

4. The slip prevention particle injection device, according to claim 1, wherein said mixing chamber is a mixing area of particles and compressed air, which is provided integrally with the air through-flow duct at a location at the outlet side with respect to a filter (13) provided in the smaller-diameter air passage section (9) in the air through-flow duct (5).

5. The slip prevention particle injection device, according to claim 1, wherein an observation window is provided in the side wall of the tank at a location in the vicinity of the air through-flow duct (5) inside the particle retaining tank.

* * * * *